United States Patent [19]

Cellone

[11] 4,357,418

[45] Nov. 2, 1982

[54] PHOTOGRAPHIC ELEMENTS WITH IMPROVED SURFACE CHARACTERISTICS

[75] Inventor: Luigi Cellone, Albisola Mare, Italy

[73] Assignee: Minnesota Mining and Manufacturing Company, St. Paul, Minn.

[21] Appl. No.: 266,647

[22] Filed: May 26, 1981

[30] Foreign Application Priority Data

May 26, 1980 [IT] Italy ..... 48795 A/80

[51] Int. Cl.[3] ..... G03C 5/26

[52] U.S. Cl. ..... 430/539; 430/950; 430/961

[58] Field of Search ..... 430/950, 961, 628, 539

[56] References Cited

U.S. PATENT DOCUMENTS

| | | | |
|---|---|---|---|
| 3,063,838 | 11/1962 | Jennings | 430/631 |
| 3,203,804 | 8/1965 | Cohen et al. | 430/628 |
| 3,272,631 | 9/1966 | Garrett et al. | 430/564 |
| 3,762,924 | 10/1973 | Morii et al. | 430/631 |

FOREIGN PATENT DOCUMENTS

| | | |
|---|---|---|
| 1073625 | 6/1967 | United Kingdom . |
| 1106717 | 3/1968 | United Kingdom . |

*Primary Examiner*—Mary F. Downey

*Attorney, Agent, or Firm*—Cruzan Alexander; Donald M. Sell; Mark A. Litman

[57] ABSTRACT

It is generally undesirable to have surfaces on photographic elements which are highly reflective and therefore reduce the attractiveness of the image. One of the traditional means of correcting this reflectance is to coat the developed film or print with an anti-reflective coating or to place a glass cover over the imaged photographic element where the glass itself has an anti-reflective surface.

According to the present invention, an anti-reflective surface may be provided within the photographic element itself by including within a top coat gelatin layer a water-soluble dextran incompatible with gelatin.

8 Claims, No Drawings

PHOTOGRAPHIC ELEMENTS WITH IMPROVED SURFACE CHARACTERISTICS

DESCRIPTION

This invention relates to silver halide photographic elements with improved surface characteristics, to coating compositions of use in manufacturing said elements, and to a method for obtaining improved surface characteristics in photographic elements during their manufacture.

Photographic elements consist of one or more gelatin layers containing silver halide emulsions spread over a support. After drying, the emulsion layer is very sensitive to physical abrasion or scratching, and developed silver impressions can form by simple pressure exerted on the silver halide granules. This defect is reduced by the application of a thin protective gelatin layer spread over the outermost emulsion layer. This protective gelatin layer is normally used in all photographic materials. Besides gelatin hardeners and coating aids, one normally incorporates matting agents, the purpose of which is to prevent or control the following mechanical and optical surface characteristics: tendency for the film to become tacky (both in the form of rolls and in sheets); excessive slipperiness; formation of Newton rings; and brightness or excessive reflectance.

Numerous matting agents, both organic and inorganic, have been described and used, but their use either alone or in combination has not enabled both the mechanical and optical surface properties of the aforesaid photographic element to be simultaneously improved, as required.

SUMMARY OF THE INVENTION

It has now been found that if water-soluble dextran of high molecular weight and incompatible with dry gelatin is included in the external protective gelatin layer of a photographic element comprising one or more silver halide emulsion layers, whether associated with gelatin extenders or otherwise, a significant anti-brightness or matting effect is produced.

DETAILED DESCRIPTION OF THE INVENTION

The present invention relates to a photographic element comprising a support, at least one photosensitive layer of silver halide emulsion in gelatin, and a non-photosensitive external protective gelatin layer, wherein said external protective gelatin layer contains a water-soluble dextran of high molecular weight which is incompatible with the gelatin, in such a quantity as to make the surface non-bright. The present invention relates in particular to a photographic element as heretofore described, wherein the protective layer has a thickness between 0.5 and 2.0 microns, and/or the average molecular weight of the dextran is at least about 200,00 or 300,000 and preferably at least 400,000 and more preferably at least 500,000, said dextran of high molecular weight preferably being in combination with a water-soluble dextran compatible with the gelatin. More particularly, the present invention relates to a photographic element as heretofore described, wherein said dextran incompatible with gelatin is present in a quantity of between 0.1 and 1.3 grams, its actual proportion with respect to the gelatin of said protective layer preferably lying between 10% and 90%, and preferably between 20% and 70% by weight. The present invention relates more particularly and preferably to a photographic element as heretofore described, wherein said dextran incompatible with gelatin is included in the protective layer in the presence of an agent for increasing the covering power of the developed silver in the emulsion layer.

According to a further aspect, the present invention relates to a method for making the surface of a photographic element non-bright, or non-glare, where this element comprises a support, at least one layer of silver halide emulsion in gelatin, and an external protective gelatin layer, said method consisting of mixing the gelatin solution of the external protective layer with the required matting agents of the finished layer before being spread over the emulsion layer, then spreading the resulting composition over the emulsion layer.

The dextran used for the purposes of the present invention can be characterized as a high molecular weight polysaccharide having an empirical formula which includes $C_6H_{10}O_5$ monomer units connected to form glucoside bonds. The preferred dextran according to the present invention has an average molecular weight of about 500,000 and a relative viscosity of 5 at 23° C. when in a 20% mixture with water. It has been found that the high molecular weight dextran useful for the purposes of the present invention must be easily soluble in water (it must have a water solubility at 20° C. of at least 0.5% by weight), be compatible with aqueous gelatin solutions (i.e. so that no phase separation or flocculation occurs when its aqueous solution is added to the aqueous gelatin solution), and be incompatible with the dry gelatin of the protective layer (i.e. distinct phases form).

The invention is not limited to a dextran having a molecular weight of 500,000, and molecular weights less or greater than this (e.g. 100,000 through 900,000) can be useful for the purposes of the present invention provided the aforesaid water solubility requirement and the requirement of incompatibility with the dry gelatin of the finished layer are satisfied.

It has also been found that the gelatin-incompatible dextran of the present invention can be used in mixture with a gelatin-compatible dextran of lower molecular weight and that this can be preferable in order not to have solutions with too high a viscosity. It has been found in particular that a mixture containing at least 25% by weight of gelatin-incompatible dextran in combination with a gelatin-compatible dextran of lower molecular weight reduces surface brightness to an extent substantially equal to that obtained by an equal quantity (by weight with respect to the mixture) of gelatin-incompatible dextran alone, with the advantage that the mixture has a viscosity that will not modify the viscosity of the gelatin solution of the protective layer.

The present invention also relates to the aforesaid photographic element, wherein said matting agents are introduced into the protective layer when the emulsion layer contains agents which increase the covering power of the developed silver. In this respect, it has been seen that the surface brightness defect is accentuated in the case of photographic elements which have been covered in those most modern industrial plants characterized by high spreading rates and high drying temperatures, and still more in the case of photographic elements of low silver content in which the covering power of the developed silver is increased by adding to the photographic emulsion special polymer materials known as gelatin extenders, such as the acrylamideacrylic ester copolymers described in Italian Pat. No. 761,724, and the low molecular weight dextran described in U.S. Pat. No. 3,063,383.

Experiments show in particular that the high molecular weight dextran should be incorporated by means of aqueous solutions (from 0.5 to 30%) into the external protective layer in the photographic element of the present invention in quantities which will modify the surface of said external protective layer and reduce the reflecting power. In particular, the high molecular weight dextran should be present in said external protective layer in a quantity of 0.1 to 1.3 grams, preferably 0.3 to 1.0 grams per square meter, and in a proportion of 10% to 90%, and preferably 20% to 70% by weight with respect to the gelatin of the protective layer, said layer preferably having a thickness of between 0.5 and 2.0 microns, and more preferably between 0.6 and 1.2 microns. The surface thus obtained comprises structural modifications which are not visible to the naked eye and cannot be measured by conventional surface roughness measuring instruments but which on microscopic examination with a magnification of 1200 times under phase contrast transparency show up as irregularities or disturbances in the form of ruptures or wrinkles of a size less than about 2 microns distributed uniformly and continuously over the entire surface.

It has been found that this surface is unique in improving the optical surface characteristics of the photographic element when observed after development; i.e. in appreciably reducing—without significant loss of transparency—the light reflected by the outer surface at the air-protective layer interface, which causes dazzling particularly in the higher density regions (this defect being particularly serious in the case of radiographic elements for use in radiography, the images of which have to be observed at length and with attention to detail).

The photographic element surface made non-bright according to the present invention has proved superior to that obtained by other agents normally used in the art, for example silica and starch. In this respect, it has been found that while silica reduces surface brightness, it projects from the element a profile of hard particles which make the element particularly abrasive. It has also been found that rice starch makes the outer surface opaque, with excessive worsening of turbidity in the layer, and thus disturbance to the vision of the element under transparency conditions. A further decisive advantage over the compounds used in the photographic art is that as high molecular weight dextran is water-soluble and compatible with the aqueous gelatin solutions of the protective layer, it gives rise to no separation or sedimentation phenomena, in contrast to the aforesaid agents which are insoluble both in water and in the aqueous gelatin solutions, thus providing an improved uniformity of the photographic layers which contain it. A further advantage of the use of dextran over the anti-brightness agents used in the art is that as it is perfectly soluble in gelatin solutions and in the spreading compositions of the protective layer, it does not clog the filters which are normally used for filtering solutions and compositions before spreading.

EXAMPLE 1

A silver bromo-iodide emulsion containing 2.2% of iodide, which had been physically cured, chemically sensitized and provided with the normal coating additives (anti-fog, stabilizers, hardeners, plasticizers and surface-active coating agents) was mixed with dextran of molecular weight 40,000 in order to increase the covering power of the silver, and divided into two parts which were each spread over the substrated face of different parts of the same polyester support to give a covering per square meter of 2.9 grams of silver and 0.7 grams of dextran. A layer of gelatin (comprising the normal spreading additives such as hardeners and surface-active agents) was spread over the first (A) of said elements. A similar layer of gelatin to which dextran of average molecular weight 500,000 (Dextran 500) in a 20% aqueous solution had been added was spread over the second (B) of said elements. Samples of the elements obtained after spreading and drying were evaluated with regard to their surface brightness and transparency characteristics. The following Table gives the measured brightness and transparency values as heretofore stated:

TABLE 1

| | Protective Layer Composition | | | |
|---|---|---|---|---|
| | Gelatin $g/m^2$ | Dextran 500 $g/m^2$ | Brightness at 20° | Turbidity |
| Element A | 1.29 | — | 44 | 0.04 |
| Element B | 0.81 | 0.48 | 15 | 0.05 |

EXAMPLE 2

A silver bromo-iodide emulsion complete with additives, as described in Example 6, was divided into three parts for spreading on both the substrated faces of different parts of the same polyester support in order to obtain on each face a layer containing, per square meter, 5.0 grams of silver and 1.1 grams of dextran of molecular weight 40,000. A protective layer of gelatin containing different quantities of Dextran 500 as shown in Table 7 was spread over both the layers of each element. The same Table shows the brightness and turbidity values measured as heretofore described.

TABLE 2

| | Protective Layer Composition | | | |
|---|---|---|---|---|
| | Gelatin $g/m^2$ | Dextran 500 $g/m^2$ | Brightness (*) | Turbidity |
| Element A | 1.3 | — | 86 | 0.10 |
| Element B | 1.3 | 0.2 | 61 | 0.15 |
| Element C | 0.6 | 0.6 | 41 | 0.18 |

(*) measured with the Gardner Glossmeter

EXAMPLE 3

A silver bromo-iodide emulsion complete with the additives described in Example 6 was divided into four parts which were each spread over the substrated face of different parts of the same polyester support to give a covering per square meter of 2.9 grams of silver and 0.7 grams of dextran of molecular weight 40,000. A layer of gelatin (to which the normal spreading agents such as hardeners and surface-active agents had been added) was spread over the first (A) of said elements. A similar layer of gelatin to which dextran of average molecular weight 40,000 (Dextran 40) in a 20% aqueous solution had been added was spread over the second (B) of said elements. A similar layer of gelatin to which dextran of average molecular weight 110,000 (Dextran 110) in a 20% aqueous solution had been added was spread over the third (C) of said elements. Finally, a similar layer of gelatin to which dextran of molecular weight 500,000 (Dextran 500) had been added was spread over the fourth (D) of said elements. The following Table gives the composition of the protective layers and the brightness and turbidity measurements. From these measurements it can be seen that only in the case of element D containing Dextran 500 was there a reduction in surface brightness without loss of transparency.

TABLE 3

| | Protective Layer Composition | | | | |
|---|---|---|---|---|---|
| | Gelatin g/m² | Dextran Molecular weight | g/m² | Brightness at 20° | Turbidity |
| Element A | 0.92 | — | — | 39 | 0.06 |
| Element B | 0.92 | 40,000 | 0.48 | 40 | 0.06 |
| Element C | 0.92 | 110,000 | 0.48 | 37 | 0.06 |
| Element D | 0.92 | 500,000 | 0.48 | 22 | 0.07 |

EXAMPLE 4

Element A of Example 6 was repeated and compared with other elements B, C, D and E prepared in the same manner but containing in their respective protective layers Dextran 500 alone (element B) and Dextran 500 in combination with Dextran 110 (elements C, D and E), as shown in the following Table. The viscosity of the dextran solutions was measured expressed as the time for a 20% solution in water at 23° C. to percolate from a 100 ml calibrated burette, and brightness and turbidity were measured by the method previously described. The results obtained are given in the following Table.

TABLE 4

| | Protective Layer Composition | | | | | |
|---|---|---|---|---|---|---|
| | Gelatin g/m² | Dextran 500 g/m² | Dextran 110 g/m² | Viscosity Dextran Solutions | Brightness at 20° | Turbidity |
| Element A | 1.29 | — | — | — | 46 | 0.05 |
| Element B | 0.81 | 0.48 | — | 173 sec | 15 | 0.06 |
| Element C | 0.81 | 0.36 | 0.12 | 146 sec | 15 | 0.06 |
| Element D | 0.81 | 0.22 | 0.22 | 98 sec | 18 | 0.05 |
| Element E | 0.81 | 0.12 | 0.36 | 82 sec | 25 | 0.06 |

The invention is not limited to the particular emulsions of the preceding Examples, in that other emulsions can be similarly used such as simple or mixed emulsions of silver chloride, silver bromo-iodide, and silver chloro-bromide, both of fine and coarse grain, and prepared by various methods as described in Research Disclosure 18341, August 1979, paragraphs 1 A and 1 B. The emulsions can be chemically sensitized during or before chemical curing by adding sensitizing agents as described in Research Disclosure 18341, August 1979, paragraph 1C. The emulsions can contain stabilizing, anti-fog, development modification and anti-staining agents, agents which increase covering power, hardeners, plasticizers and anti-creasing agents as described in Research Disclosure 18341, August 1979, paragraphs II and II A–K. The emulsion can be sensitized spectrally, for example, in the wavelength region of the light emitted by the reinforcing screens in the case of elements used for radiography, as described in Research Disclosure 18341, August 1979, paragraphs IX and X. In addition, besides gelatin and its partial or total substituent, the protective layer can comprise dyes, plasticizers, anti-static agents and development accelerators as described in Research Disclosure 18341, August 1979, paragraph IV. The emulsion is preferably spread over a polyester support as described in Research Disclosure 18341, August 1979, paragraph XII, but other supports, for example, cellulose derivatives (cellulose nitrate, cellulose triacetate, cellulose propionate, cellulose acetate propionate, etc.), polyvinylchloride, polystyrene, polycarbonates, glass, paper etc. can be used. The photographic element according to the present invention can in addition comprise anti-static agents and layers as described in Research Disclosure 18341, August 1979, paragraph III.

The invention has been described in particular for black and white photographic elements, preferably for radiographic use. It is, however, not limited to said elements, and can also be used for color photographic elements comprising a plurality of silver halide emulsion layers sensitized towards different regions of the visible spectrum and containing color formers or coupling agents capable of forming dyes by chromogenic development of the exposed element with paraphenylenediamine developers.

I claim:

1. A photographic element comprising a support and a plurality of gelatine layers which comprise a silver halide emulsion layer and a non-photosensitive external gelatin protective layer, wherein said external gelatin protective layer comprises a reflectance reducing quantity of water-soluble dextran having a molecular weight of at least 100,000 which is incompatible with gelatin.

2. A photographic element as claimed in claim 1, wherein said protective layer has a thickness between about 0.5 and about 2.0 microns and said dextran has a molecular weight between 100,000 and 900,000.

3. A photographic element as claimed in claim 2, wherein said dextran incompatible with gelatin is mixed with a water-soluble dextran compatible with gelatin.

4. A photographic element as claimed in claim 2, wherein said dextran incompatible with gelatin has an average molecular weight of between 300,000 and 900,000.

5. A photographic element as claimed in claim 3, wherein said dextran incompatible with gelatin has an average molecular weight of between 300,000 and 900,000.

6. A photographic element as claimed in claim 4 or 5, wherein said dextran incompatible with gelatin is present in the proportion of between about 10% and about 90% with respect to the gelatin of the protective layer and the average molecular weight of the dextran is at least 200,000.

7. A photographic element as claimed in claim 4 or 5, wherein said dextran incompatible with gelatin is present in the proportion of between about 10% and about 90% with respect to the gelatin of the protective layer and is included in the protective layer in the presence of agents with increase the covering power of the silver in said emulsion layer.

8. A method for making the surface of a photographic element non-bright, wherein the element comprises a support and a plurality of gelatin layers which comprise at least one silver halide emulsion layer and a non-photosensitive external protective layer, consisting of mixing a gelatin coating composition for the external protective layer with an aqueous solution of a dextran having a molecular weight of at least 100,000 which is incompatible with dry gelatin before being spread over said at least one emulsion layer, then spreading the resulting composition over said at least one emulsion layer.

* * * * *